US009478865B1

(12) United States Patent
Willis et al.

(10) Patent No.: US 9,478,865 B1
(45) Date of Patent: Oct. 25, 2016

(54) CONFIGURABLE HORN ANTENNA

(71) Applicant: L-3 Communications Corporation, New York, NY (US)

(72) Inventors: Bryan Willis, Layton, UT (US); Neil K. Harker, South Jordan, UT (US); Timothy G. Riggs, Taylorsville, UT (US); Brandon G. Walsh, Syracuse, UT (US)

(73) Assignee: L-3 Communications Corp., New York, NY (US)

( * ) Notice: Subject to any disclaimer, the term of this patent is extended or adjusted under 35 U.S.C. 154(b) by 0 days.

(21) Appl. No.: 14/574,998

(22) Filed: Dec. 18, 2014

(51) Int. Cl.
*H01Q 13/02* (2006.01)
*H01Q 21/00* (2006.01)
*H01Q 13/06* (2006.01)

(52) U.S. Cl.
CPC ..... *H01Q 13/02* (2013.01); *H01Q 21/0006* (2013.01)

(58) Field of Classification Search
CPC ..... H01P 1/10; H01P 1/12; H01P 1/122; H01Q 13/02; H01Q 13/06
USPC ..... 333/106, 258, 259, 261, 21 R, 21 A; 343/777, 778, 786, 776, 780
See application file for complete search history.

(56) References Cited

U.S. PATENT DOCUMENTS 3,009,117 A * 11/1961 Lanctot ..... H01P 1/122 333/108
3,155,925 A * 11/1964 Wantuch ..... H01P 1/122 333/1.1
3,852,762 A * 12/1974 Henf ..... H01Q 3/12 343/756
6,448,869 B1 * 9/2002 Kich ..... H01P 1/122 333/106
6,879,297 B2 * 4/2005 Brown ..... H01Q 19/08 343/772
6,933,900 B2 * 8/2005 Kitamori ..... H01Q 1/3233 343/713
8,581,794 B1 * 11/2013 Shor ..... H01Q 9/0421 343/772
2002/0101300 A1 * 8/2002 Kudrle ..... H01P 1/18 333/156
2006/0176124 A1 * 8/2006 Mansour ..... H01P 1/122 333/108
2015/0380815 A1 * 12/2015 Boutayeb ..... H01Q 13/00 343/777

OTHER PUBLICATIONS

Advanced Engineering Electromagnetics, Balanis, Chapter 8.*

* cited by examiner

*Primary Examiner* — Dameon E Levi
*Assistant Examiner* — Awat Salih
(74) *Attorney, Agent, or Firm* — Workman Nydegger

(57) ABSTRACT

A configurable antenna may include a circular horn array comprising a plurality of horn antennas, a configurable waveguide in a center of the circular horn array, and a plurality of actuators. The configurable waveguide includes a plurality of retractable triangular wedges, with one side of each wedge oriented to one of the plurality of horn antenna and a corner oriented toward a center of the waveguide, wherein a circle defined by each of the corners oriented toward the center of the waveguide defines a first circumference. The configurable waveguide further includes a plurality of movable tuning rods arranged in a circle defining a second circumference, the second circumference being smaller than the first circumference, said movable tuning rods further arranged such that the movable tuning rods are between the corners the corners oriented toward the center of the waveguide.

12 Claims, 7 Drawing Sheets

CONFIGURABLE HORN ANTENNA

BACKGROUND

Due to the decreasing size of Unmanned Arial Vehicles (UAVs) and size and weight limitations on airborne platforms such as UAVs, equipment suppliers are often faced with requirements that constrain space and weight allowances available for electronics equipment. For example, in some airborne platform applications, only one antenna is allowed. Typically, this would have to be an antenna with an omnidirectional beam pattern. These antennas have low gain (normally 3 dB) and do not allow communication over long distances.

There are certain applications where a small, lightweight antenna that functions with both omni-directional low gain radiation and directional high gain radiation is desirable. One prior solution to this problem is to provide a circular horn array with 360 degree coverage. The horn array may be switched electronically to use fewer than all of the horns, thereby increasing gain. However, differences in impedance when in omni-mode (all horns active) and directional mode (one or two horns active) adversely impacts the Voltage Standing Wave Ratio (VSWR) and other performance characteristics.

SUMMARY

This configurable horn antenna of the present invention provides a small platform with a single antenna solution that will function in omni mode for close range or discovery communication and the ability to use the same antenna as a high gain tracking antenna that allows for long distance communication. The present configurable horn antenna meets the small size and low weight requirement with a single antenna solution that functions in both directional high gain mode and omni-directional mode and improves upon the performance characteristics of earlier designs Improved performance is provided by a mechanical waveguide style switches for switching from omni-mode to directional mode.

A configurable antenna according to a preferred aspect of the present invention includes a circular horn array comprising a plurality of horn antennas, a configurable waveguide in a center of the circular horn array, and a plurality of actuators. The configurable waveguide includes a plurality of retractable triangular wedges, with one side of each wedge oriented to one of the plurality of horn antenna and a corner oriented toward a center of the waveguide, wherein a circle defined by each of the corners oriented toward the center of the waveguide defines a first circumference. The configurable waveguide further includes a plurality of movable tuning rods arranged in a circle defining a second circumference, the second circumference being smaller than the first circumference, said movable tuning rods further arranged such that the movable tuning rods are between the corners the corners oriented toward the center of the waveguide.

The configurable waveguide is configured by retracting one or more wedges and adjacent tuning rods, thereby forming a pseudo waveguide. A given horn antenna is coupled to the configurable waveguide when the corresponding wedge and adjacent tuning rods are retracted. The plurality of actuators are provided to retract or deploy the wedges and the tuning rods. Each actuator is linked to one wedge and the two movable tuning rods adjacent to the wedge. The number of tuning rods equals the number of wedges, so any given tuning rod may be actuated by any one of two adjacent actuators.

The configurable antenna may be operated in omni-directional mode by retracting all of the wedges to couple the configurable waveguide to all of the horn antennas of the circular horn array. The configurable antenna may be operated in directional mode by configuring the wedges to couple the configurable waveguide to fewer than all of the horn antennas of the circular horn array. The configurable antenna may be operated in multi-directional mode by configuring the wedges to couple the configurable waveguide to at least one selected horn antenna in a first group and at least one selected horn antennas in a second group, the first and second groups of horn antennas being non-adjacent to each other.

The circular horn array comprises a top horn assembly, a bottom horn assembly, and a plurality of trapezoidal wedges between the top horn assembly and the bottom horn assembly.

Preferably, the pseudo waveguide is approximately 0.75 wavelength wide by 0.2 wavelength tall at a nominal operating frequency of the configurable horn antenna.

DETAILED DESCRIPTION

Figure 1:
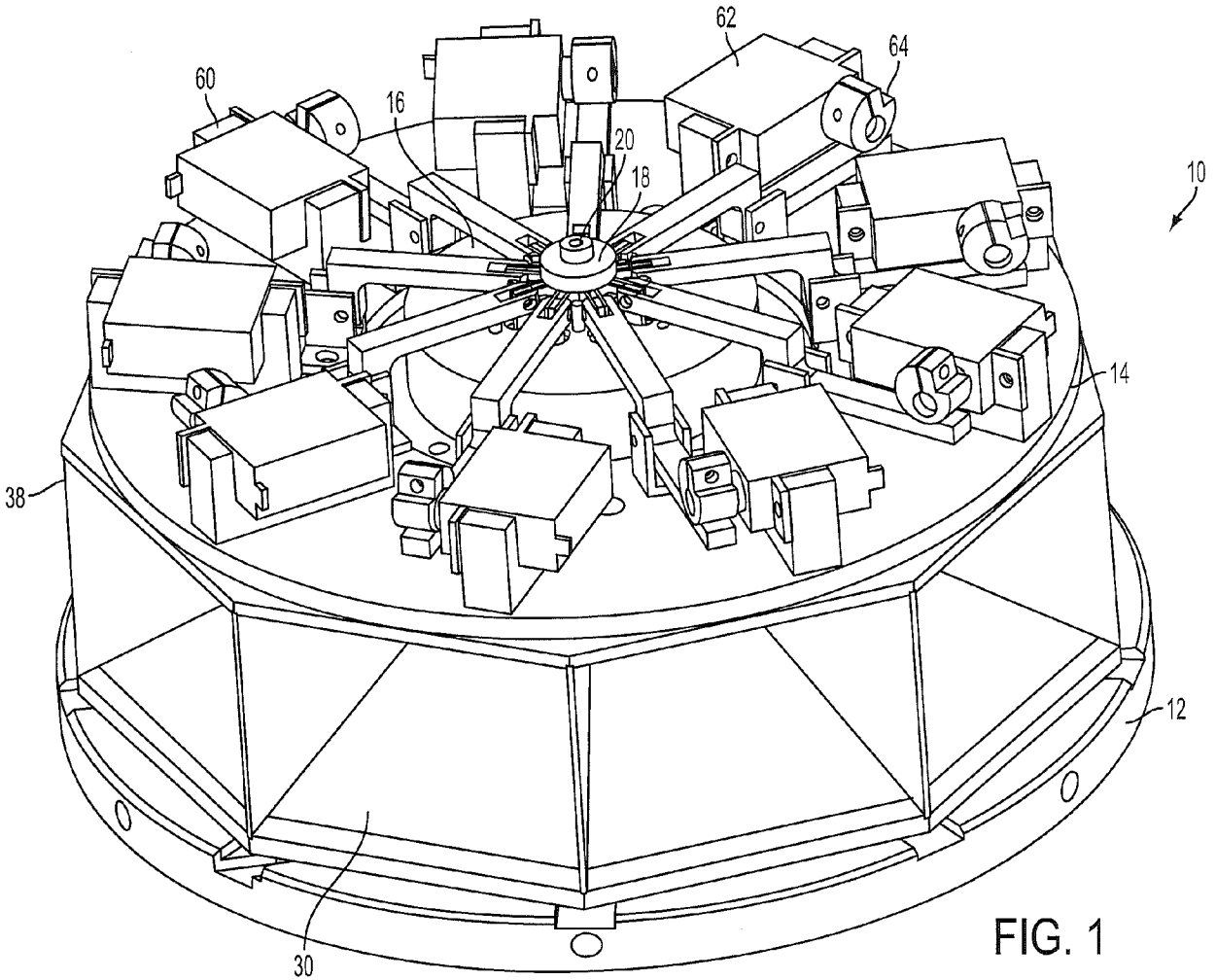
FIG. 1 is an illustration of one embodiment of a configurable horn antenna according to the present invention.

A configurable horn antenna 10 is illustrated in FIG. 1. The configurable horn antenna 10 includes a horn array 30, a plurality of actuator mechanisms 60, a bottom mounting plate 12, a top mounting plate 14, a middle hub 16, a threaded rest 18, and tuner plug 20. A radome (not shown) may be attached to the bottom mounting plate 12 and enclose the horn array 30 and the actuator mechanisms 60.

Figure 2:
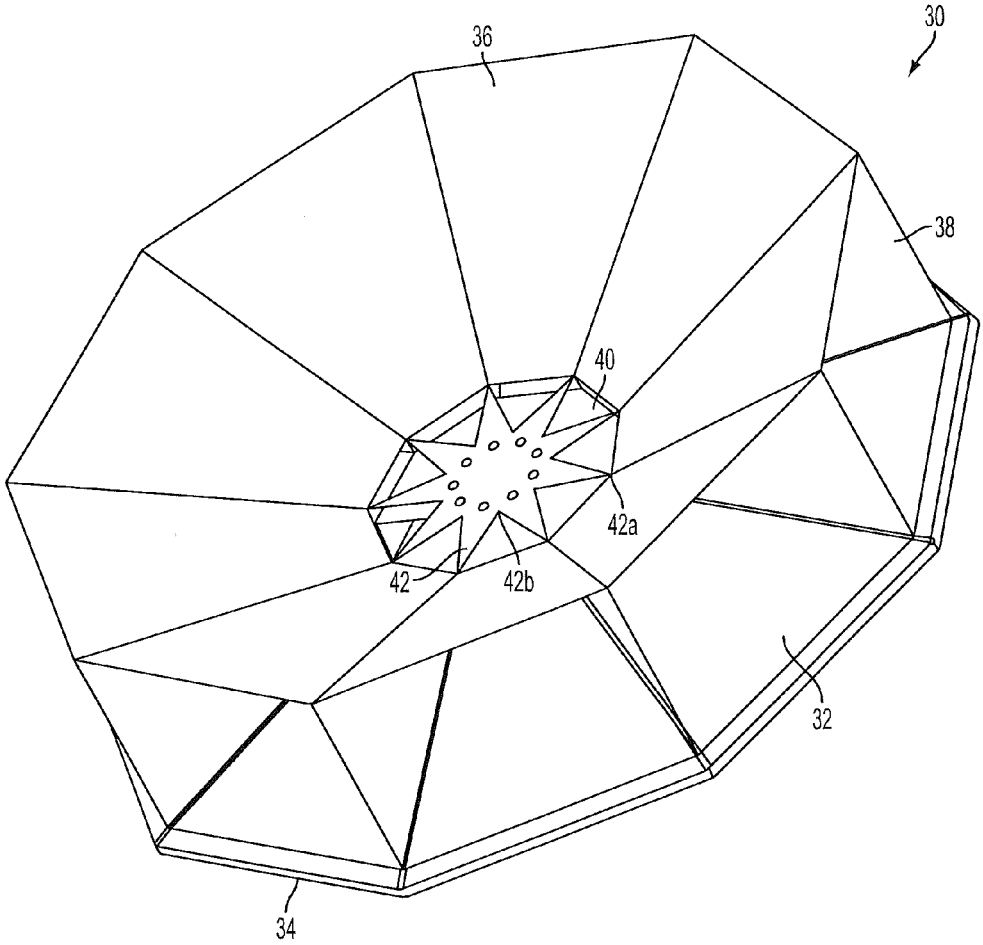
FIG. 2 is a perspective view of a horn array according to the present invention.
Figure 3:
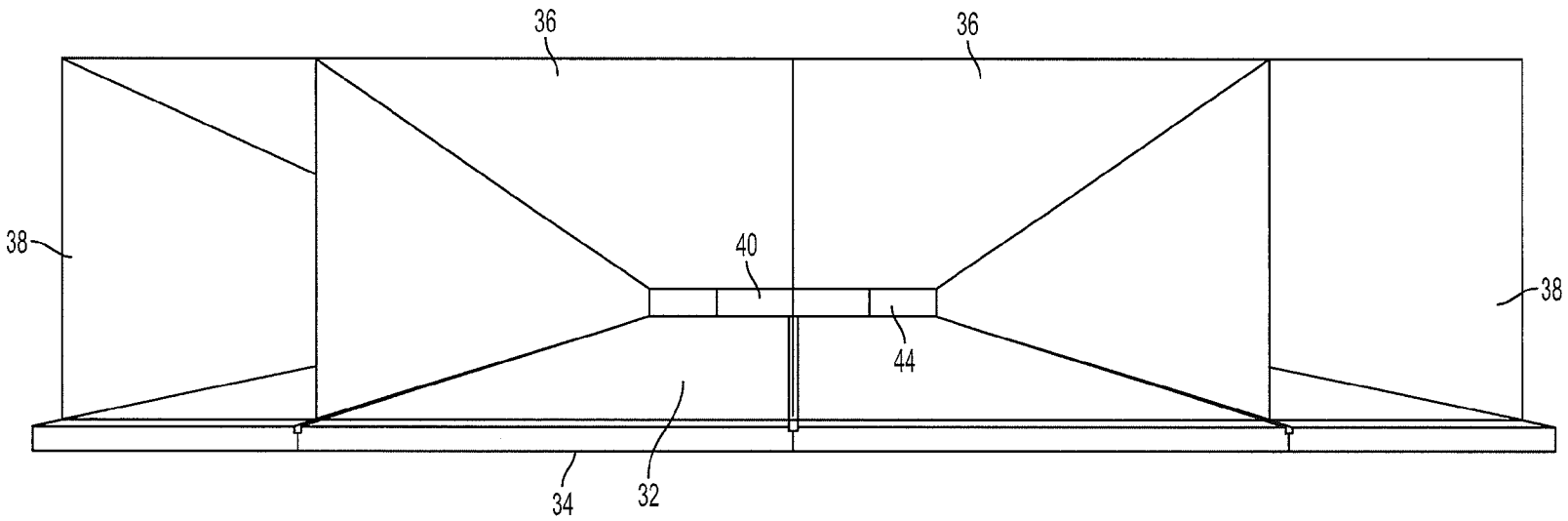
FIG. 3 is a side view of a horn array according to the present invention.

The horn array 30 is illustrated in isolation in FIGS. 2 and 3. The descriptions given with respect to reference characters in FIGS. 2 and 3 also apply to other figures in which those reference characters appear. Horn array 30 includes a plurality of horn antennas 32. The horn antennas 32 are defined by a bottom horn assembly 34, a top horn assembly 36 and a plurality of trapezoidal fins 38. In the illustrated example, the top horn assembly 36, bottom horn assembly 34 and plurality of fins 38 define nine horn antennas 32 extending generally radially from a center axis of the horn array 30. Greater or fewer horn antennas 32 may be defined without departing from the scope of the invention.

At the center of the horn array 30 is a configurable waveguide 40. A feed probe (not shown) is disposed within the configurable waveguide 40 to receive and/or transmit RF energy. Referring to FIGS. 2-5, to configure the configurable waveguide 40, a star 42 is included on a lower surface of the top horn assembly 36, above the waveguide. The star has nine "ear" vertices 42*a*, each oriented towards one of the plurality of fins 38. The star wedge also has nine "mouth" vertices 42*b*, substantially centered with an aperture 44 defined by the top horn assembly 36, the bottom horn assembly 34, and two of the plurality of fins 38.

A plurality of wedges 46 are movably located between the ear vertices 42*a* of the star 42. Preferably, the wedges 46 are triangle-shaped and define an area that completely fills the area defined by two ear vertices 42*a* and one mouth vertex 42*b*. A base of each wedge 46 is oriented toward an aperture 44.

Figure 7:
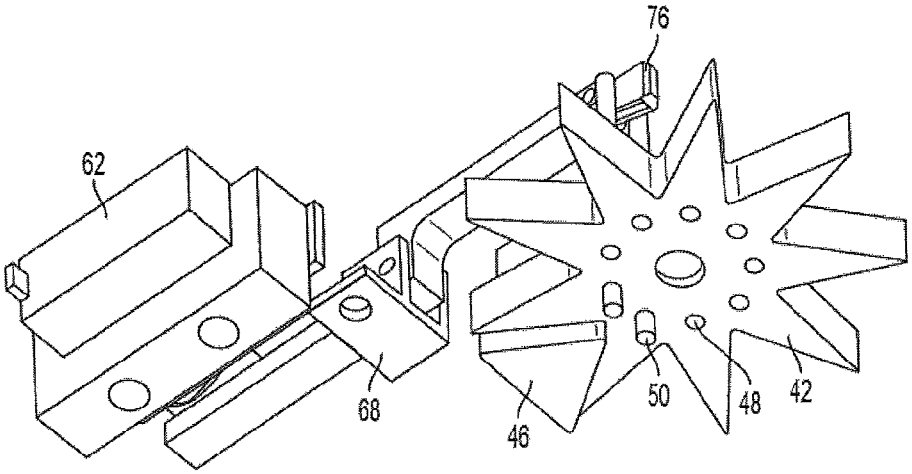
FIG. 7 is an illustration of an actuator mechanism and waveguide switching apparatus according to the present invention.

The star 42 also includes a plurality of tuning rod apertures 48 and a center aperture 52 (FIG. 7). Moveable tuning rods 50 are disposed within the tuning rod apertures 48. The tuning rod apertures 48 are located such that they are substantially aligned with the ear vertices 42*a* of the star 42, but closer to the center of the star 42 than the mouth vertices 42*b*. The tuner plug 20 is disposed within center aperture 52 of the star 42.

Figure 4:
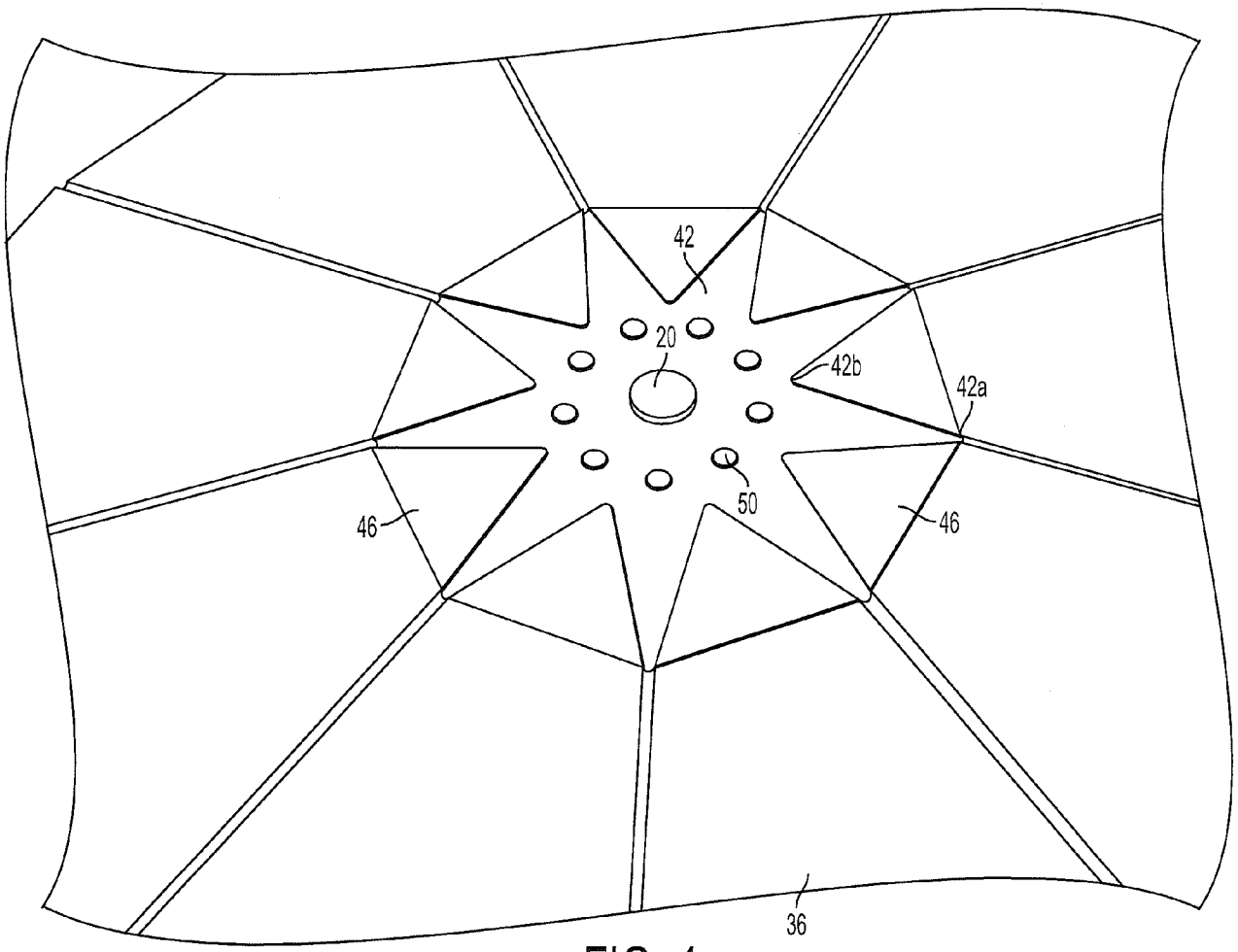
FIG. 4 is an illustration of a top horn assembly in a first configuration according to the present invention.

FIG. 4 is an illustration of the top horn assembly 36 with all of the wedges 46 and tuning rods 50 retracted, and the tuner plug 20 deployed. When the wedges 46 and tuning rods 50 are so configured, each horn antenna 32 of the horn array 30 is coupled to the configurable waveguide 40 of the configurable horn antenna 10. In this configuration, the configurable horn antenna 10 operates in omni-directional mode.

Figure 5:
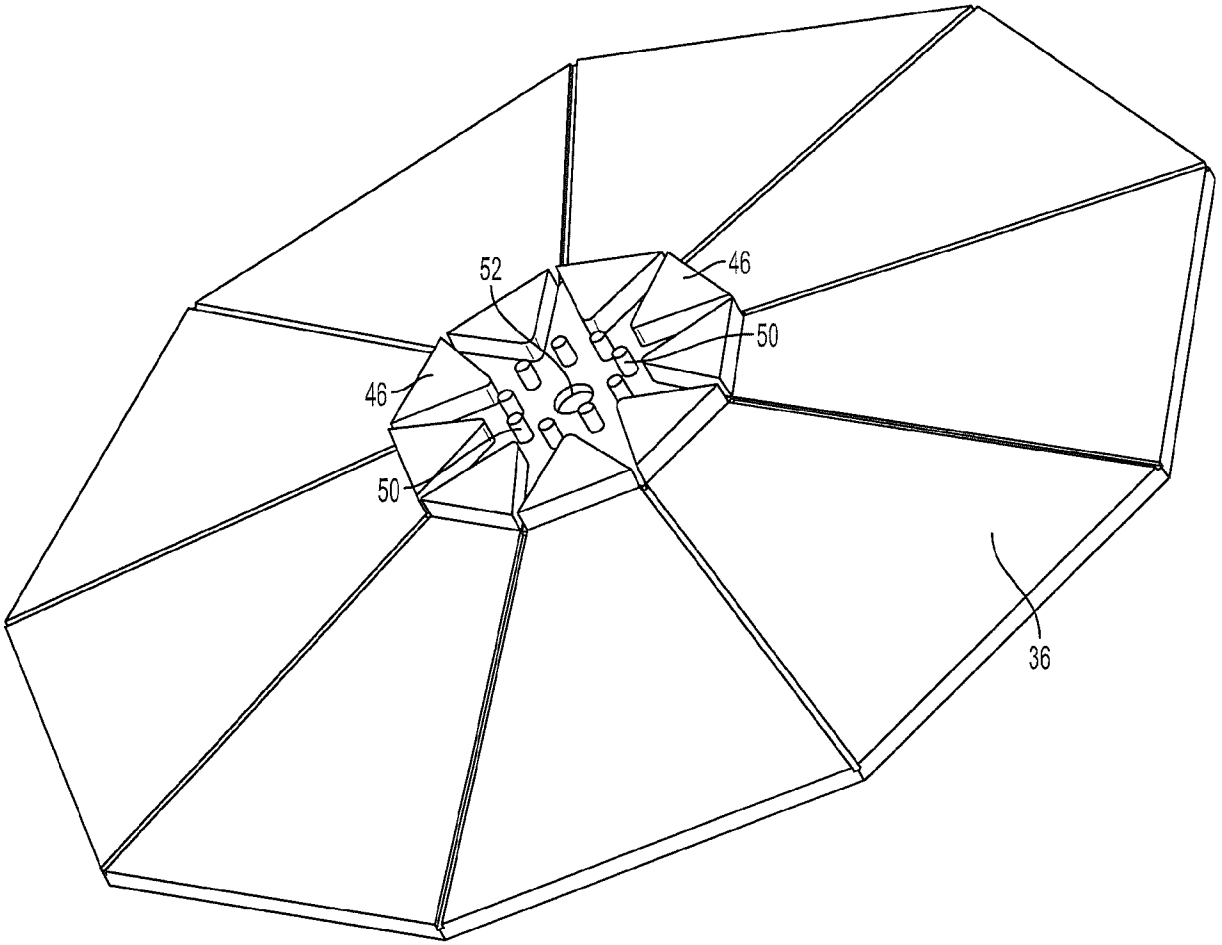
FIG. 5 is an illustration of a top horn assembly in a second configuration according to the present invention.

FIG. 5 is an illustration of the top horn assembly 36 with all of the wedges 46 and tuning rods 50 deployed, and the tuner plug 20 retracted. When the wedges 46 and tuning rods 50 are so configured, each horn antenna 32 of the horn array 30 is blocked from the configurable waveguide 40 of the configurable horn antenna 10.

Figure 6:
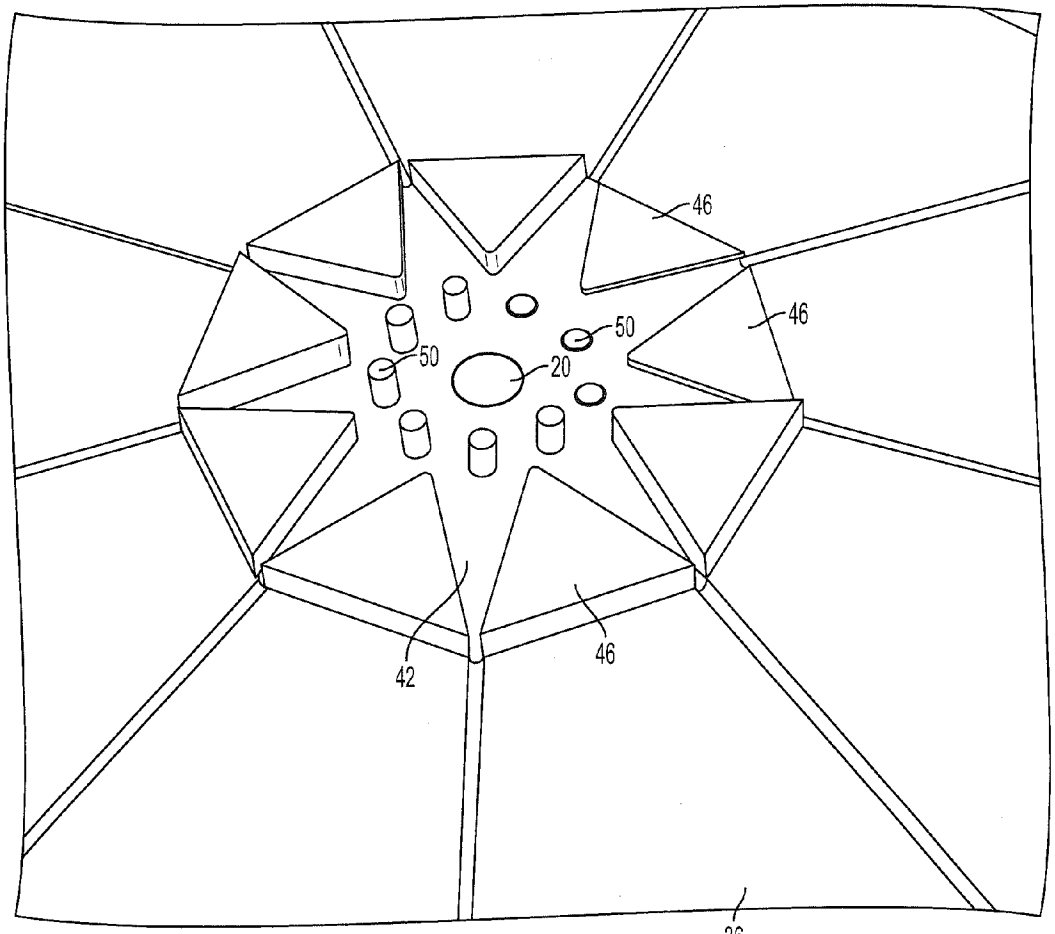
FIG. 6 is an illustration of a top horn assembly in a third configuration according to the present invention.

By selectively retracting wedges 46 and tuning rods 50, selected horn antennas 32 of the horn array 30 may be coupled to the configurable waveguide 40. When so configured, the configurable horn antenna 10 operates in directional mode. For example, FIG. 6 illustrates the top horn assembly 36 with two of the wedges 46 and three of the tuning rods 50 retracted, and the tuner plug 20 retracted. The remaining wedges 46 and tuning rods 50 are deployed. When the wedges 46 and tuning rods 50 are so configured, two of the horn antennas 32 of the horn array 30 are coupled to the configurable waveguide 40 of the configurable horn antenna 10. The remaining horn antennas 32 are blocked from the configurable waveguide 40 of the horn array 30.

Figure 8:
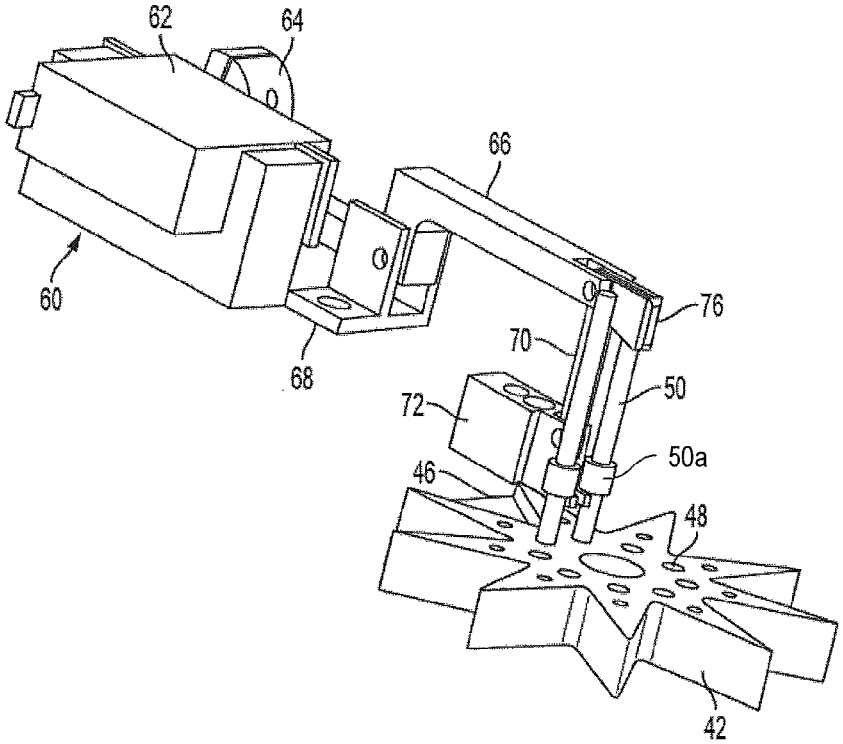
FIG. 8 is an alternate view of an actuator mechanism and waveguide switching apparatus according to the present invention.

The wedges 46 and tuning rods 50 are moved by the plurality of actuator mechanisms 60. The actuator mechanisms 60 are mounted on top of the top mounting plate 14. FIGS. 7 and 8 illustrate an actuator mechanism 60, the star 42, a wedge 46 and two tuning rods 50 in isolation from other components. The actuator mechanism 60 may comprise a servo 62 with a cam 64 on a shaft of the servo 62. In the illustrated example, the cam 64 actuates an arm 66, which pivots about a rocker 68. The arm 66 may have different lengths on either side of the rocker 68. In this way, the throw of the arm 66 at the cam 64 may be increased or decreased as may be necessary to achieve a range of throw at the end of the arm 66 that is opposite of the servo 62 and cam 64.

The atm 66 is connected to a longitudinal linkage 70. The longitudinal linkage 70 is connected to a lifter 72. The lifter 72 is configured to engage a lower shoulder of a collar 50*a* on two adjacent tuning rods 50. A spring (not shown) may be disposed on each tuning rod 50, engaging a top shoulder of the collar 50*a*. The spring biases the tuning rod 50 downward.

The lifter 72 is also connected to a wedge 46. When a single lifter 72 is actuated, it lifts the wedge 46 and the two tuning rods 50 to which it is coupled. When the next adjacent lifter 72 is actuated, one of the two tuning rods 50 to which the second lifter 72 is ordinarily coupled will already have been lifted by the first lifter 72. Accordingly, only the wedge 46 and one additional tuning rod 50 will be lifted. Accordingly, when the configurable horn antenna 10 is configured to use two adjacent horns in directional mode, two wedges 46 and three tuning rods 50 will be lifted as shown in FIG. 6.

The actuator mechanism 60 further includes a lifter slider 76. Each of the lifter sliders 76 of the plurality of actuator mechanisms 60 engages threaded rest 18. Threaded rest 18 is connected to tuner plug 20. When all of the lifters 72 are actuated, all of the wedges 46 and tuning rods 50 are lifted, threaded rest 18 is lowered by the lifter sliders 76, and tuner plug 20 is deployed through center aperture 52.

Another mode of operation is a multi-beam mode. In multi-beam mode, two or more non-adjacent lifters are actuated, lifting at least two non-adjacent wedges and activating at least two non-adjacent horns. As a result, two separate directional beams which are not co-located may be generated, i.e.: one beam can point West and one beam can point East.

A benefit of using this mechanical switch approach is that there is no loss due to using MEMs or diodes. Another benefit is that the corner reflector of wedges 46 and tuner rods 50 match the VSWR of the antenna as it functions in omni and directional mode. The tuner rod 50 and wedge 46 placement are configured to create a pseudo waveguide. For a desired nominal frequency of operation, the pseudo waveguide is approximately 0.75 wavelength wide by 0.2 wavelength tall. The pseudo waveguide allows the reflected wave to circulate to the open aperture/s and not back through the transmission line increasing efficiency and gain. The improvements over electronically switched antennas are given Table 1.

TABLE 1

| Parameter | Mechanical Waveguide Switched Array | Electrically Switched Array |
|---|---|---|
| Moving parts | Yes | No |
| Gain (directional) | 10 dBi | 6 dBi |
| Gain (omni) | 2 dBi | 0 dBi |
| Bandwidth | 14.4-17.4 GHz | 14.4-15.4 GHz |
| Size | 2.5" hgt 6.1" dia | 2.5" hgt 6.6" dia |
| Switching time | 250 ms | 100 us |

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

What is claimed is:

1. A configurable antenna, comprising:

a. a circular horn array comprising a plurality of horn antennas;

b. a configurable waveguide in a center of the circular horn array, the configurable waveguide including a plurality of movable elements to configure a shape of the configurable waveguide and to selectively couple the configurable waveguide to selected horn antennas of the circular horn array;

c. a plurality of actuators linked to the movable elements, wherein each of the plurality of movable elements comprises a wedge, wherein each wedge is associated with one of the plurality of horn antennas, and wherein the configurable wave guide further comprises a plurality of movable tuning rods arranged in a circle and offset from the wedges, and wherein a given horn antenna is coupled to the configurable wave guide when the corresponding wedge and adjacent tuning rods are retracted.

2. The configurable antenna of claim 1, wherein each wedge comprises a triangular wedge with one side oriented toward one of the plurality of horn antennas.

3. The configurable antenna of claim 1, wherein the circular horn array may be operated in omni-directional mode by configuring the movable elements to couple the configurable waveguide to all of the horn antennas of the circular horn array.

4. The configurable antenna of claim 1, wherein the circular horn array may be operated in directional mode by configuring the movable elements to couple the configurable waveguide to fewer than all of the horn antennas of the circular horn array.

5. The configurable antenna of claim 1, wherein the circular horn array may be operated in multi-directional mode by configuring the movable elements to couple the configurable waveguide to at least one selected horn antenna in a first group and at least one selected horn antennas in a second group, the first and second groups of horn antennas being non-adjacent to each other.

6. The configurable antenna of claim 1, wherein the circular horn array comprises a top horn assembly, a bottom horn assembly, and a plurality of trapezoidal wedges between the top horn assembly and the bottom horn assembly.

7. A configurable antenna, comprising:

a. a circular horn array comprising a plurality of horn antennas;

b. a configurable waveguide in a center of the circular horn array, the configurable waveguide including:

1. a plurality of retractable triangular wedges, with one side of each wedge oriented to one of the plurality of horn antenna and a corner oriented toward a center of the waveguide, wherein a circle defined by each of the corners oriented toward the center of the waveguide defines a first circumference;

2. a plurality of movable tuning rods arranged in a circle defining a second circumference, the second circumference being smaller than the first circumference, said movable tuning rods further arranged such that the movable tuning rods are between the corners oriented toward the center of the waveguide;

wherein the configurable waveguide is configured by retracting one or more wedges and adjacent tuning rods; and c. a plurality of actuators, each actuator linked to one wedge and two movable tuning rods.

8. The configurable antenna of claim 7, wherein a given horn antenna is coupled to the configurable waveguide when the corresponding wedge and adjacent tuning rods are retracted.

9. The configurable antenna of claim 7, wherein the circular horn array may be operated in omni-directional mode by retracting all of the wedges to couple the configurable waveguide to all of the horn antennas of the circular horn array.

10. The configurable antenna of claim 7, wherein the circular horn array may be operated in directional mode by configuring the wedges to couple the configurable waveguide to fewer than all of the horn antennas of the circular horn array.

11. The configurable antenna of claim 7, wherein the circular horn array may be operated in multi-directional mode by configuring the wedges to couple the configurable waveguide to at least one selected horn antenna in a first group and at least one selected horn antennas in a second group, the first and second groups of horn antennas being non-adjacent to each other.

12. A configurable antenna, comprising:

a. a circular horn array comprising a plurality of horn antennas;

b. a configurable waveguide in a center of the circular horn array, the configurable waveguide including a plurality of movable elements to configure a shape of the configurable waveguide and to selectively couple the configurable waveguide to selected horn antennas of the circular horn array;

c. a plurality of actuators linked to the movable elements, wherein the circular horn array comprises a top horn assembly, a bottom horn assembly, and a plurality of trapezoidal wedges between the top horn assembly and the bottom horn assembly.

* * * * *